United States Patent [19]

Cebulski

[11] Patent Number: 5,026,954

[45] Date of Patent: Jun. 25, 1991

[54] LIQUID LEVEL SENSING SWITCH ASSEMBLY

[75] Inventor: David J. Cebulski, Whitmore Lake, Mich.

[73] Assignee: Hi-Stat Manufacturing Co., Inc., Sarasota, Fla.

[21] Appl. No.: 422,083

[22] Filed: Oct. 16, 1989

[51] Int. Cl.[5] ..... H01H 35/18

[52] U.S. Cl. ..... 200/84 C; 73/313; 340/624

[58] Field of Search ..... 335/205, 206, 207, 302, 335/303; 307/118; 340/623, 624; 116/109, 110, 204; 73/308, 313, 319, DIG. 5; 200/84 R, 84 B, 84 C, 61.2

[56] References Cited

U.S. PATENT DOCUMENTS

| | | | |
|---|---|---|---|
| 2,133,077 | 10/1938 | Boddy | 200/122 |
| 2,684,414 | 7/1954 | Kilpatrick | 200/84 |
| 2,744,177 | 5/1956 | Barber | 200/84 |
| 2,899,517 | 8/1959 | Hastings et al. | 200/84 |
| 3,167,623 | 1/1965 | Kaleta | 200/84 |
| 3,211,856 | 10/1965 | Bakke | 200/84 |
| 3,227,839 | 1/1966 | Brown | 200/87 |
| 3,342,960 | 9/1967 | Dillon et al. | 200/84 |
| 3,562,735 | 2/1971 | Goodlaxson | 200/84 C |
| 3,691,522 | 9/1972 | Hocking et al. | 340/52 C |
| 3,750,124 | 7/1973 | Barnes et al. | 340/244 E |
| 3,798,401 | 3/1974 | Kochanski et al. | 200/84 C |
| 3,849,770 | 11/1974 | Hayashida | 200/84 C |
| 4,090,050 | 5/1978 | Siiberg | 200/84 C |
| 4,467,156 | 8/1984 | Dvorak et al. | 200/84 R |
| 4,500,761 | 2/1985 | Kubota | 200/84 C |
| 4,609,796 | 9/1986 | Bergsma | 200/84 C |
| 4,638,663 | 1/1987 | Seelhorst | 340/624 |
| 4,691,185 | 9/1987 | Loubier | 335/207 |
| 4,837,537 | 6/1989 | Nakada | 335/205 |

FOREIGN PATENT DOCUMENTS

| | | | |
|---|---|---|---|
| 1518966 | 3/1968 | France | 200/84 C |

*Primary Examiner*—Gerald P. Tolin
*Attorney, Agent, or Firm*—Lon H. Romanski

[57] ABSTRACT

A liquid level response electrical switch assembly responsive to the level of a monitored liquid is shown as having a body and a chamber-like or containment portion, electrical conductors are carried by the body for connection to as associated electrical load, a reed switch is carried by and within the body for opening and closing an electrical circuit through the electrical conductors, and a magnet positioned by a buoyant float responsive to the level of the monitored liquid is effective for actuating the reed switch.

18 Claims, 6 Drawing Sheets

LIQUID LEVEL SENSING SWITCH ASSEMBLY

FIELD OF THE INVENTION

This invention relates generally to electrical switch assemblies and more particularly to electrical switch assemblies effective for opening or closing electrical circuits in response to the sensed level of a monitored liquid.

BACKGROUND OF THE INVENTION

Heretofore the prior art has proposed various forms or types of electrical switches which were responsive to the level (height or elevation) of a monitored liquid. For the most part such prior art switches may be considered as being of two types.

For example, one of such types would comprise switches employing a float which, upon being buoyantly moved upwardly by the monitored fluid, would apply a force as against a normally open (or closed) switch arm causing such switch arm to be moved to a closed (or open) position. In this type of prior art switch, the act of switch closure (or opening) is somewhat irregular in action since such closure (or opening) movement is related to the speed of change in fluid level and consequently there may be an occurrence of an unstable making and breaking of the associated electrical circuit prior to such switch being placed into a stable electrically closed (or open) condition.

The other type of prior art switch would comprise switches employing a float which, in turn, carries a bridging-like electrical conductor so that upon being moved by the monitored fluid the bridging-like conductor would engage related stationary electrical contacts or terminals of an associated electrical circuit thereby closing such electrical circuit. This type of prior art switch also exhibits an irregular electrical closing action with occurrences of unstable making and breaking of the associated electrical circuit prior to such switch being placed into a stable electrically closed (or open) condition.

Further, in such prior art switches, it is often accepted practice to have the various elements, such as contacts, switch arms, and/or bridging contacts, exposed to the liquid being monitored with such exposure permitting at least the vapor of the monitored liquid and even splashing of the monitored liquid to come into contact with such electrically conductive switching elements. This, in turn, often causes a corrosive action on such switching elements resulting in switch failure or at least unreliable switch operation.

Accordingly, the invention as herein disclosed is primarily directed to the aforestated as well as other related and attendant problems of the prior art.

SUMMARY OF THE INVENTION

According to one aspect of the invention, a liquid level responsive electrical switch assembly responsive to the level of monitored liquid, comprises housing means, said housing means comprising body means and chamber-like means, electrical conductor means carried by said body means for operative connection to associated electrical load means, electrical reed switch means having first and second states of operation, wherein when in said first state of operation said reed switch means is effective for opening an electrical circuit through said electrical conductor means, wherein when in said second state of operation said reed switch means is effective for closing an electrical circuit through said electrical conductor means, wherein said electrical reed switch means is carried by and within said body means, magnet means situated within said chamber-like means, said magnet means when moved toward said body means and said electrical reed switch means so as to be spaced from said electrical reed switch means by a preselected distance being effective to cause said reed switch means to change from one of said states of operation to the other of said states of operation, and buoyant float means acted upon and responsive to the level of said monitored liquid for causing said magnet means to be moved toward and away from said body means and said electrical reed switch means in response to the rise and fall of the level of said monitored liquid.

In another aspect of the invention a method of manufacturing a liquid level responsive electrical switch assembly responsive to the level of a monitored liquid, comprises the steps of forming electrical conductor means, connecting a reed switch assembly in electrical circuit with the electrical conductor means, placing the reed switch assembly and said electrical conductor means as an assembly and as an insert into a mold cavity, filling the mold cavity with a dielectric material as to thereby form a dielectric body which encapsulates the reed switch assembly and at least in part surrounds the conductor means, forming a containment member to provide a chamber-like means, forming a magnet member, forming a buoyant float member, placing the magnet member and buoyant float member into the chamber-like means, and securing the dielectric body to the containment member to thereby complete the manufacture and assembling of the electrical switch assembly.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
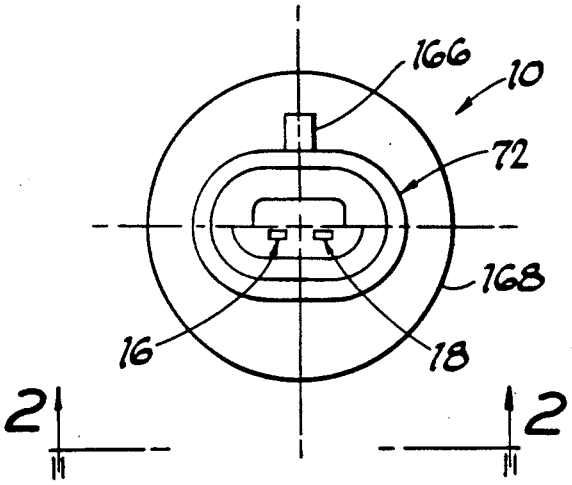
FIG. 1 is a top or end elevational view of a switch assembly embodying teachings of the invention.
Figure 2:
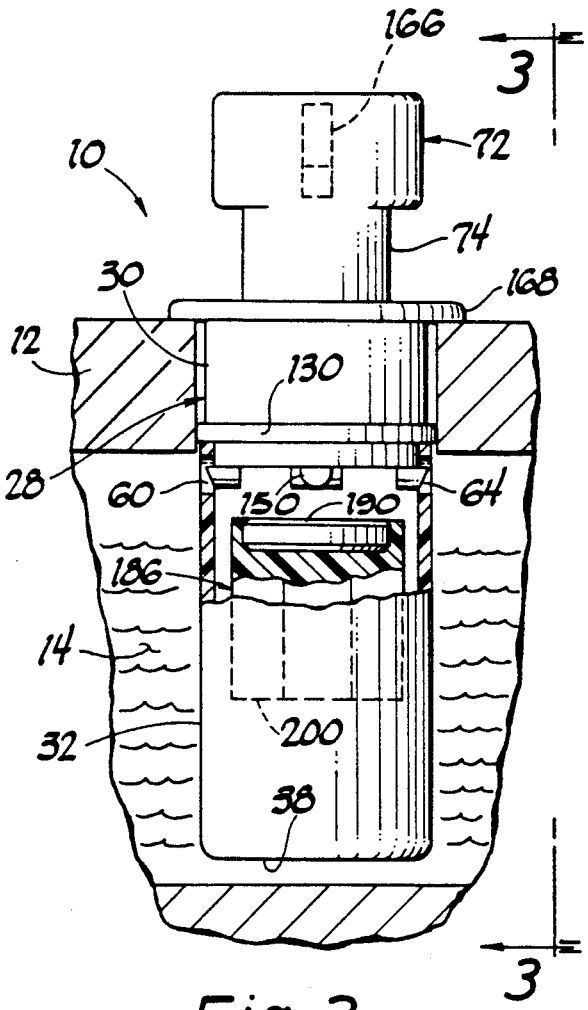
FIG. 2 is a view taken generally on the plane of line 2—2 of FIG. 1, looking in the direction of the arrows, with related or associated structure (not shown in FIG. 1) being shown, fragmentarily, in cross-section.
Figure 3:
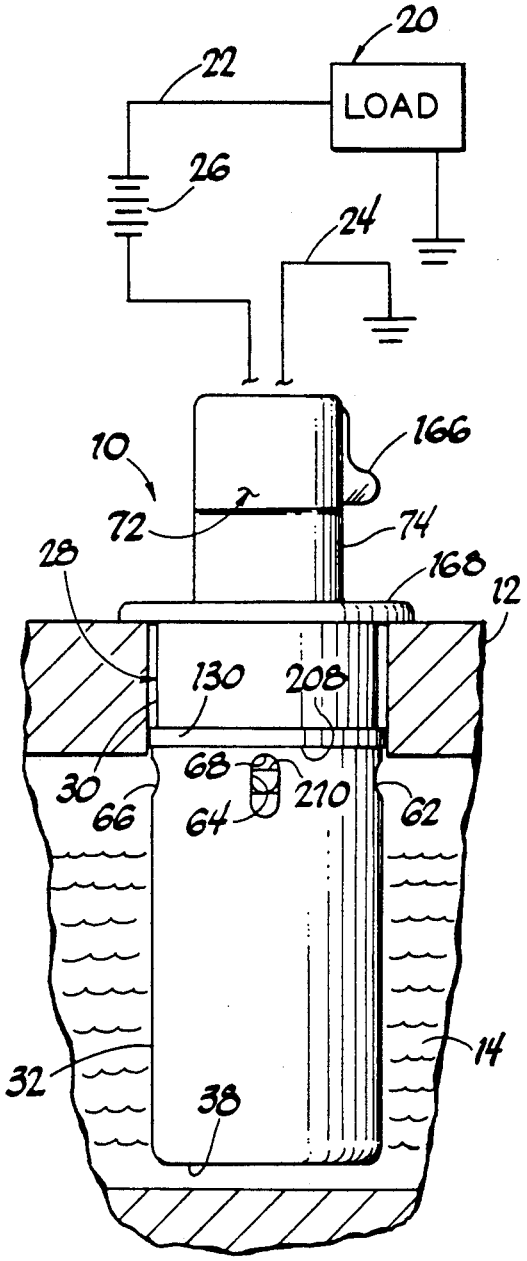
FIG. 3 is a view taken generally on the plane of line 3—3 of FIG. 2 and looking in the direction of the arrows.

Referring now in greater detail to the drawings, FIGS. 1, 2 and 3 illustrate a switch assembly 10 carried as by associated structure 12 for sensing and responding to the liquid level of a liquid 14 situated as within the structure 12. The switch assembly 10 is depicted as comprising electrical terminal means 16 and 18 and such, in turn, are, in operation, respectively electrically connected to associated load means 20 as through conductor means 22 and 24 wherein conductor means 22 may comprise a suitable source of electrical potential 26. Conductor means 22 and 24 may, of course, as is well known in the art, comprise a portion of a terminal type connector which would be connectable to the switch assembly 10.

As generally illustrated in FIGS. 2 and 3, the switch assembly 10 is comprised of overall housing or body means 28 and such, in turn, may be considered as comprising relatively upper housing or body means 30 and relatively lower housing or body means 32.

Figure 4:
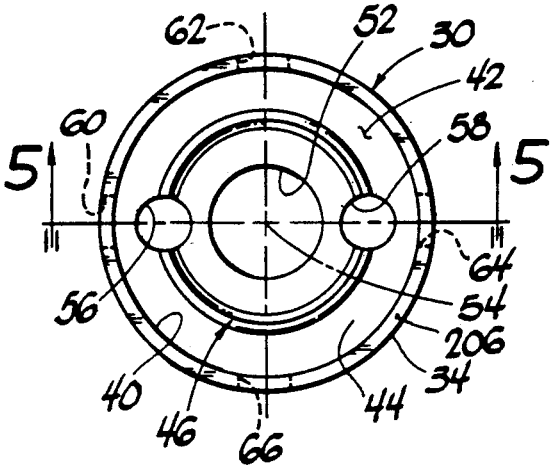
FIG. 4 is an axial end view, in relatively enlarged scale, of one of the elements shown in FIGS. 2 and 3.
Figure 5:
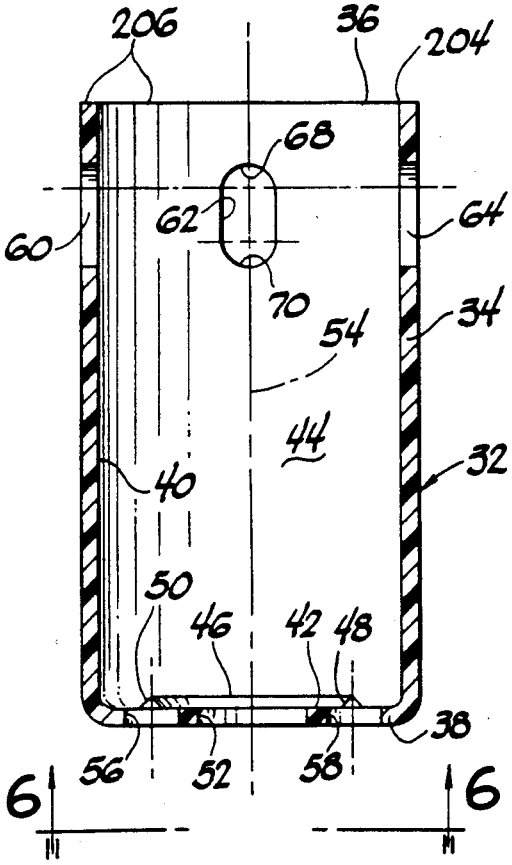
FIG. 5 is a cross-sectional view taken generally on the plane of line 5—5 of FIG. 4 and looking in the direction of the arrows.

Referring in greater detail to FIGS. 4, 5, 6 and 7, the lower housing means 32 is illustrated as comprising a generally cylindrical tubular body 34 which at its upper end 36 is open and which, at its lower end, has a transverse axial end wall 38. In the preferred embodiment, housing or body means 32 is formed of plastic, such as, for example, polypropylene, as by molding. Accordingly, in the preferred embodiment, end wall 38 would be integrally molded with the main tubular body 34. As best seen in FIGS. 4 and 5, the body 34 comprises an inner cylindrical surface 40 which extends axially therealong as to, in effect, abut or terminate in the inner surface 42 of end wall 38. The space generally cooperatively defined by end surface 42 and inner surface 40 may, for ease of description, be considered a chamber means 44.

Figure 7:
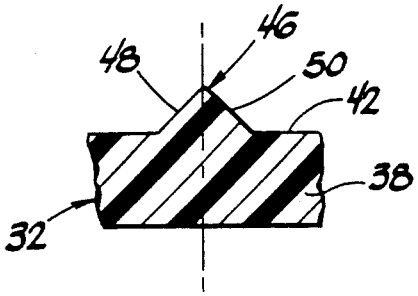
FIG. 7 is a cross-sectional view, in still further relatively enlarged scale, of a fragmentary portion of the structure of FIGS. 4, 5 and 6, taken generally on the plane of line 7—7 of FIG. 6 and looking in the direction of the arrows.

In the preferred embodiment, the end wall 38 carries an abutment means which, preferably, is in the form of an annular rib or raised portion 46. As best seen in FIGS. 5 and 7, the raised portion or rib 46 may be of an inverted V-like configuration having annularly extending side walls 48 and 50.

Figure 6:
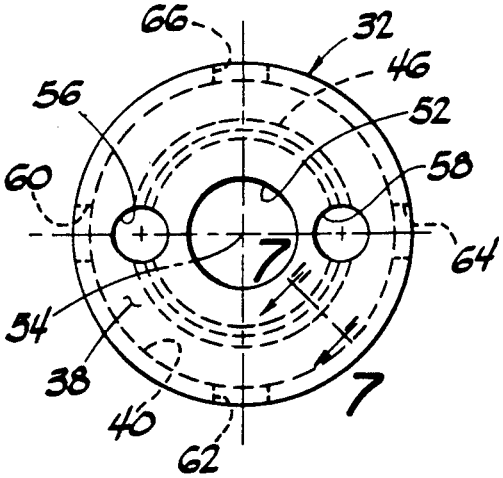
FIG. 6 is a view taken generally on the plane of line 6—6 of FIG. 5 and looking in the direction of the arrows.

The end wall 38 is also provided with a plurality of apertures or passages formed therethrough. A relatively larger passage 52 is preferably formed as to be generally axially aligned with the axis 54 of body means 32 while relatively smaller passages 56 and 58 are formed as to each be between cylindrical wall 34 and passage 52. As shown in FIGS. 4, 5 and 6, in forming apertures or passages 56 and 58 the rib or raised portion 46 is intersected thereby as to result in respective discontinuities of the raised portion or abutment means 46.

Further, as shown in FIGS. 4, 5 and 6, a plurality of relatively elongated apertures or passages 60, 62, 64 and 66 are formed through wall 34. In the preferred embodiment, as typically depicted by aperture 62, each of said apertures or passages 60, 62, 64 and 66 are provided with semi-circular end 68 and 70.

Referring now in greater detail to FIGS. 8, 9, 10, 11 and 20, the upper housing or body means 30 is illustrated as comprising a generally upwardly situated portion 72, a medially situated generally necked portion 74 and a downwardly situated portion 76 all of which are preferably integrally molded of a suitable dielectric material such as, for example, a heat stabilized 33.0% glass filled nylon.

Figure 8:
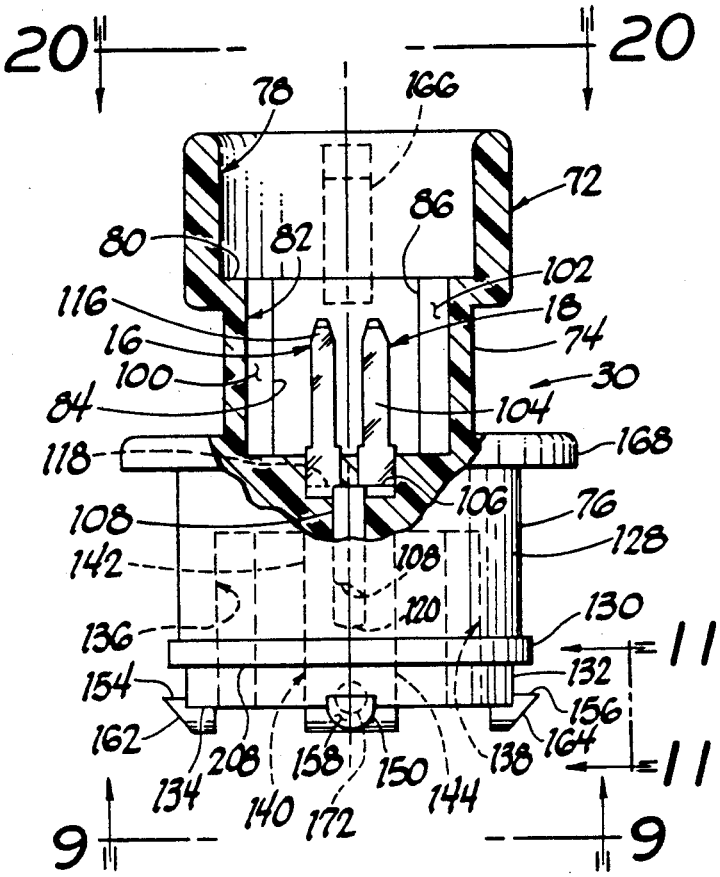
FIG. 8 is a generally side elevational view, in relatively enlarged scale and partially broken-away and in cross-section, of another portion of the switch assembly shown in FIGS. 1, 2 and 3.
Figure 20:
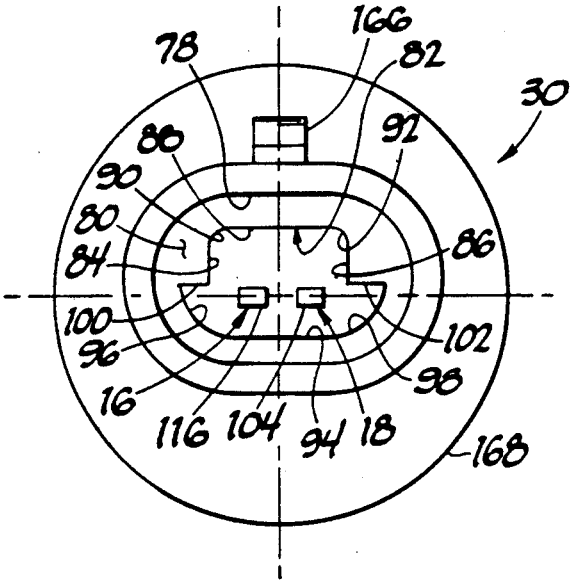
FIG. 20 is a view (similar to that of FIG. 1 but in relatively enlarged scale) taken generally on the plane of line 20—20 of FIG. 8 and looking in the direction of the arrows.

The upper body section or portion 72 is provided with a generally centrally situated axially extending bore or passage 78 terminating as at an inner flange or shoulder 80. A second or continued opening or passage 82 is formed inwardly of passage 78 and is in general communication therewith. As best seen in FIGS. 8 and 20, the passage 82 is preferably configured as to be polarized and thereby receive a similarly shaped mating electrical plug (not shown) which carries socket like electrical contacts. More particularly, as best seen in FIGS. 8 and 20, the passage, opening or cavity 82 is depicted as comprising opposed generally flat walls 84 and 86, spaced from each other, a third generally flat wall 88 with arcuate wall portions 90 and 92 which collectively span the distance between and effectively join respective one ends of walls 84 and 86. A wall 94 opposed to and spaced from wall 88 has arcuate end portions 96 and 98 which respectively join wall portions 100 and 102 with such, in turn, joining walls 84 and 86. The body section 30 is, as previously indicated, preferably molded and in the process of molding, as will become even more apparent, terminal means 16 and 18, which may be comprised of brass, are molded into and retained by body or housing portion 30.

Figure 14:
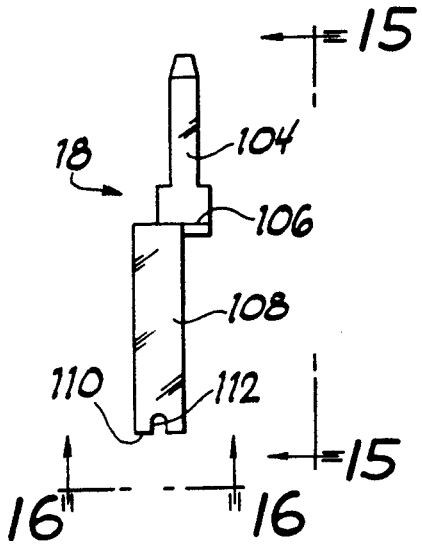
FIG. 14 is an elevational view, in relatively enlarged scale, of one of the elements shown in FIG. 1.
Figure 15:
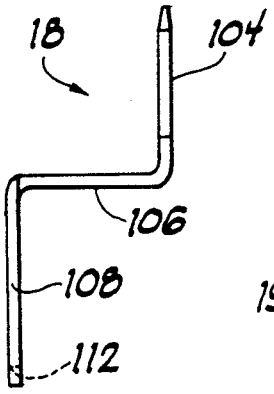
FIG. 15 is a view taken generally on the plane of line 15—15 of FIG. 14 and looking in the direction of the arrows.
Figure 16:
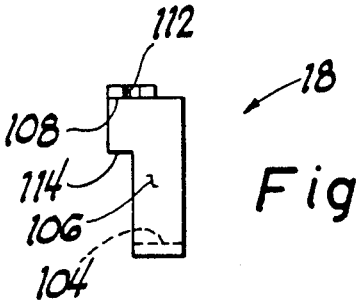
FIG. 16 is a view taken generally on the plane of line 16—16 of FIG. 14 and looking in the direction of the arrows.

Referring in greater detail to FIGS. 14, 15 and 16, the terminal means 18 is depicted as comprising a main blade-like body 104 having an integrally formed transversely extending body portion 106 from which an integrally formed leg-like portion 108 depends. As best seen in FIG. 14, the lower end 110 of leg 108 is provided with a slot-like opening 112 formed therein. Also, as best seen in FIG. 14, the leg 108 is somewhat offset from lateral body portion 106 and blade 104 and, as shown in FIG. 16, the body portion 106 is preferably enlarged as at 114.

Figure 17:
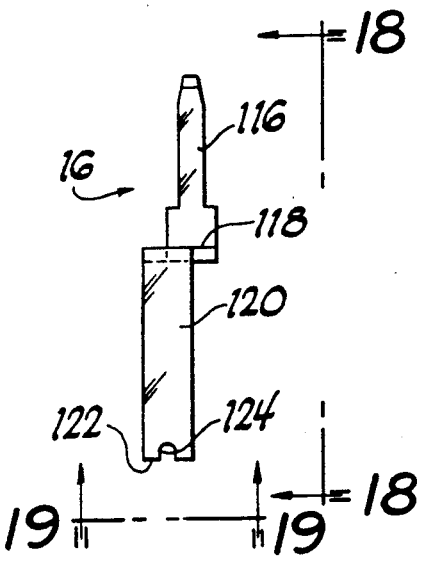
FIG. 17 is an elevational view, in relatively enlarged scale, of another of the elements shown in FIG. 1.
Figure 18:
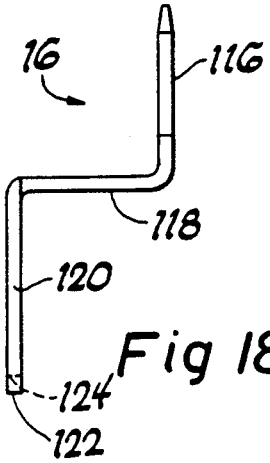
FIG. 18 is a view taken generally on the plane of line 18—18 of FIG. 17 and looking in the direction of the arrows.
Figure 19:
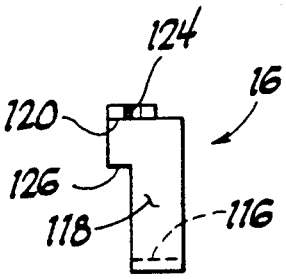
FIG. 19 is a view taken generally on the plane of line 19—19 of FIG. 17 and looking in the direction of the arrows.

Referring in greater detail to FIGS. 17, 18 and 19, the terminal means 16 is depicted as comprising a main blade-like body 116 having an integrally formed transversely extending body portion 118 from which an integrally formed leg-like portion 120 depends. As best seen in FIG. 17, the lower end 122 of leg 120 is provided with a slot-like opening 124 formed therein. Also, as best seen in FIG. 17, the leg 120 is somewhat offset from lateral body portion 118 and blade 116 and, as shown in FIG. 19, the body portion 118 is preferably enlarged as at 126.

Referring to FIGS. 8–11 and 14–22, the lower body portion 76, of upper housing section 30, is illustrated as comprising a generally cylindrical outer surface 128 which preferably terminates in a radially outwardly directed annular flange 130. The body portion 76 extends downwardly, beyond flange 130, and, preferably, has an outer cylindrical surface 132 of a diameter less than that of surface 128. The body 76 may be considered as terminating in an axial end surface 134.

Figure 9:
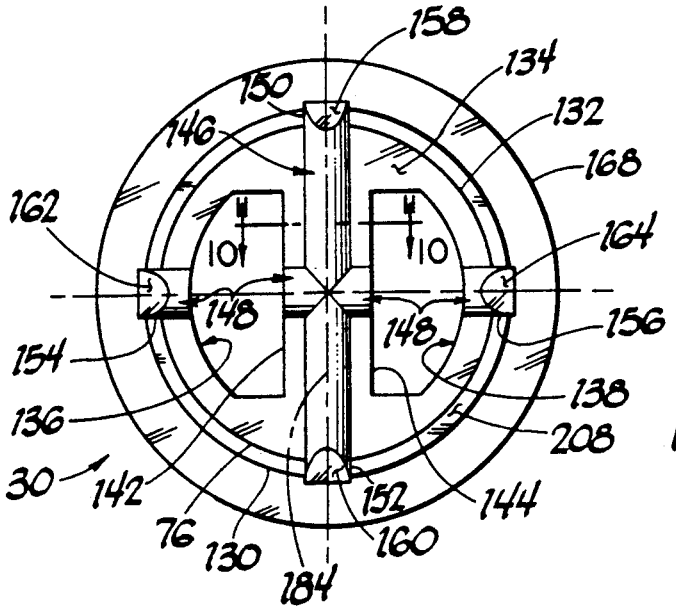
FIG. 9 is a view taken generally on the plane of line 9—9 of FIG. 8 and looking in the direction of the arrows.

In the preferred embodiment, body 76 is molded as to have spaced, generally longitudinally extending, pockets, chambers or recesses 136 and 138 which, in turn, define a medially situated body portion 140 therebetween having oppositely disposed wall surfaces 142 and 144. As best seen in FIGS. 8 and 9, the lower end of body portion 76 has integrally formed therewith a plurality of raised or rib-like portions 146 and 148 which are situated as to be diametrically extending and normal to each other. As shown in both FIGS. 8 and 9, in the preferred embodiment the respective chambers or recesses 136 and 138 result in causing the rib means 148 to become discontinuous while the axis of rib means 146 is generally parallel to the walls 142 and 144 of recesses 136 and 138.

Also as shown in FIGS. 8 and 9, rib means 146 is provided with integrally formed oppositely directed end portions 150 and 152 each of which extend beyond cylindrical surface 132; similarly, rib means 148 is also provided with integrally formed oppositely directed end portions 154 and 156 each of which extend beyond cylindrical surface 132. Further, end portions 150, 152, 154 and 156 are respectively provided with lead-type or camming surfaces 158, 160, 162 and 164.

In the preferred embodiment, as best seen in FIGS. 3, 8 and 20, the upper housing portion 72 is preferably formed as to provide an integrally formed ear-like projection 166 which functions as a latching means for latchably securing an electrical connector assembly not shown) which would be electrically connected to terminals 116 and 104 and possibly engage the inner and/or outer surfaces of upper portion 72 of housing section 30. Further, in the preferred embodiment, a radially outwardly extending annular flange 168 is formed at what may be generally considered the upper region of body portion 76.

Figure 21:
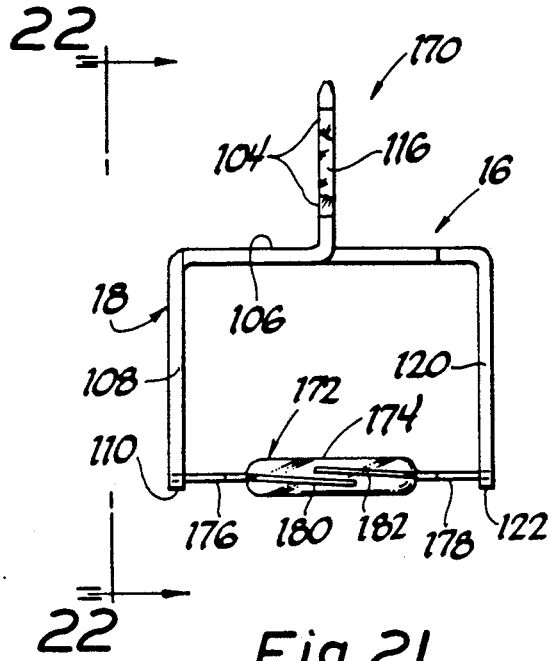
FIG. 21 is an elevational view of certain of the elements shown in FIGS. 1, 8, 10 and 14
Figure 22:
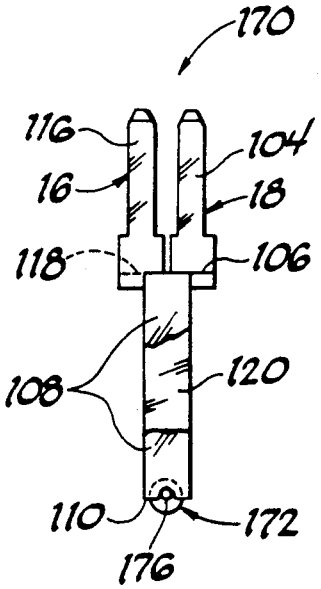
FIG. 22 is a view taken generally on the plane of line 22—22 of FIG. 21 and looking in the direction of the arrows.

As was previously indicated, in the preferred embodiment the terminal means 16 and 18 (FIGS. 14-19) are integrally molded into housing section 30 at the time that such housing section 30 is being molded. To better understand the configuration and placement of such terminal means 16 and 18 within the overall housing section 30, reference is now made in particular to FIGS. 21 and 22 along with secondary reference to FIGS. 8, 9 and 10. As depicted in FIGS. 21 and 22, the terminal means 16 and 18 are arranged with respect to each other as to assume the relationships depicted therein whereby terminal contacts or blade 104 and 116 become, in a side-by-side manner, aligned with each other (a portion of blade 104 being broken-away in FIG. 21 as to better illustrate this relationship with regard to blade 116) and whereby legs 108 and 120 are in spaced alignment with each other (a portion of leg 108 being broken-away in FIG. 22 as to better illustrate this relationship with regard to leg 120).

In effect, with the terminal means 16 and 18 positioned as depicted in FIGS. 21 and 22, a sub-assembly 170 is created by electrically and physically connecting thereto a reed switch assembly 172 having an enveloping housing 174 and electrical leads 176 and 178 respectively connected to reed switch contacts or leafs 180 and 182 which, in the embodiment depicted, are normally electrically open. Lead 176 is secured, in electrical conductivity to leg 108, as by soldering thereof within slot-like opening 112 of leg 108 while lead 178 is similarly soldered within slot-like opening 124 of leg 120.

With the assembly 170, which may also be considered to be the switching means, being maintained as in the configuration of FIGS. 21 and 22, the assembly 170 is suitably placed as within the mold cavity which is to be employed for molding the upper housing section 30. Upon completion of such molding, the assembly 170 has its position, relative to the remainder of the upper housing section 30, as generally depicted in FIG. 8.

Figure 10:
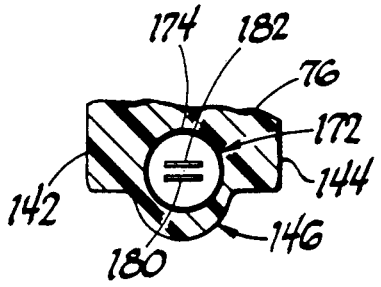
FIG. 10 is a cross-sectional view, in still further relatively enlarged scale, of a fragmentary portion of the structure of FIGS. 8 and 9, taken generally on the plane of line 10—10 of FIG. 9 and looking in the direction of the arrows.

With greater particularity to FIG. 8, it can be seen that: (a) the lateral body portions 118 and 106, of terminal means 16 and 18, are contained within the molded material forming body portion 76; (b) the axis of reed switch assembly 172 is parallel to (if not coincident with) axis 184 of rib 146; and (c) the legs 108 and 120 (partially broken-away) extend, for a distance, in the molded material forming body portion 76 and, as depicted in FIGS. 21 and 22, are in electrical engagement with leads 176 and 178 of reed switch assembly 172. In the preferred embodiment, the reed switch 172 is so positioned as to result in the integrally molded rib 146 providing in the order of, but at least, 0.020 inch of material covering the reed switch housing 174 as best seen in FIG. 10.

Figure 13:
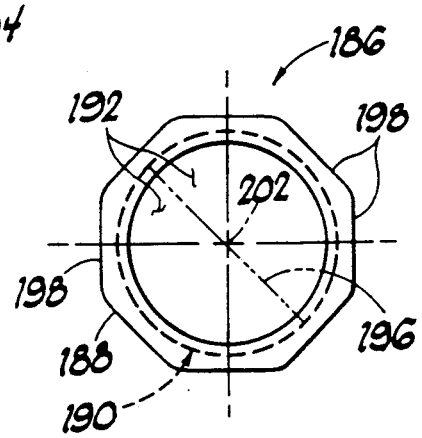
FIG. 13 is a view taken generally on the plane of line 13—13 of FIG. 12 and looking in the direction of the arrows.
Figure 12:
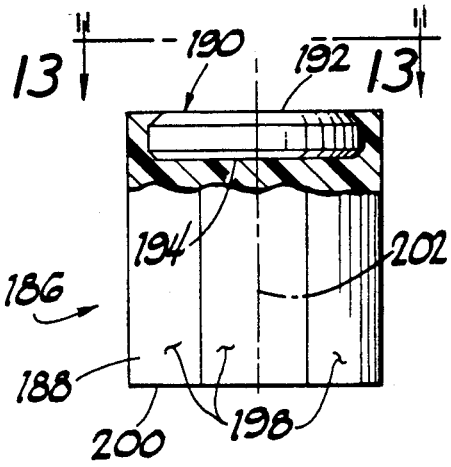
FIG. 12 is a generally elevational view, in relatively enlarged scale and with portions broken-away and in cross-section, of a sub-assembly shown in FIG. 2.

FIGS. 12 and 13 illustrate a float assembly 186 which is depicted as comprising float body means 188 and magnet means 190 carried thereby. In the preferred embodiment, the magnet means 190 is of a disk-like configuration having opposite circular surfaces or faces 192 and 194. The magnet means 190 is magnetized as to have two magnetic poles on each face 192 and 194. For example, face 192, in the area generally upwardly and to the right of phantom line 196, could be magnetized "north" while, on the same face 192, in the area generally below and to the left of phantom line 196, could be magnetized "south".

The float assembly 186 is preferably formed as by molding and, at that time, integrally molding, as an insert (having its face 192 exposed), the magnet means 190 to the float body 188. Further, in the preferred form, the float body 188 is formed as to have its outer surface 198 in an octagonal configuration as viewed in FIG. 13. The float body 188 may be formed of any suitable material as, for example, "Nitrophyl". "Nitrophyl" is a United States of America registered trademark of Rogers Corporation of Willimantic, Conn., U.S.A., for an expanded form of nitrile rubber. As best seen in FIG. 12, the lower end of float body 188 may be a flat surface 200 substantially normal to the longitudinal axis 202 of the assembly 186.

With the foregoing processes completed, all that remains is the assembly of the upper housing section 30, float assembly 186 and lower housing section 32. In order to do this all that needs to be done is to place the float and actuator assembly 186 into chamber 44 of lower housing section 32, as to have end 200 of assembly 186 directed toward end wall 38, and then insert end surface 132 of upper housing section 30 into the lower housing section 32.

More particularly, the lower housing section 32 being comprised of material which is relatively resiliently yieldable, as the upper housing section 30 is being pushed into the open end 36 of lower housing section 32, the camming surfaces 162, 158, 164 and 160 of upper housing section 30 first engage the annular corner portion 204 of the lower housing section 32 and upon further relative downward (or inward) movement of upper housing section 30 such camming surfaces 158, 160, 162 and 164 resiliently urge juxtaposed portions of the cylindrical body 34 generally radially outwardly thereby enabling the projecting portions 150, 152, 154 and 156 to pass inwardly of and against the inner surface 40 of lower housing section 32.

When the upper housing section 30 is sufficiently pushed inwardly of lower housing section 32, the projecting portions 150, 152, 154 and 156 become respectively received within apertures 66, 62, 60 and 64 of lower housing section 32 thereby simultaneously enabling the upper portion of the resiliently yieldable material of lower housing section to again move generally radially inwardly as to engage the pilot-like surface means 132 (of upper housing section 30) and to have the upper annular end surface 206 of lower housing section 32 to abut against the lower surface 208 of annular flange 130. At this time the upper and lower housing sections 30 and 32 become effectively locked to each other and fixed, in such assembly, against both axial and angular relative movement. Thereafter, the assembly 10 may be inserted into related structure 12, as generally depicted in FIGS. 2 and 3, and suitably secured thereto, as to thereby have the float and actuating assembly 186 responsive to the elevation (height) of the fluid 14 and have the assembly 10 effective to respond to the elevational height of the monitored fluid 14.

OPERATION OF THE INVENTION

In the embodiment disclosed, the monitoring switch assembly 10 is of the normally electrically open type. However, the teachings herein disclosed apply equally well to such a monitoring switch assembly 10 which is of the normally electrically closed type and the scope of the invention as herein after claimed is intended to apply to both types.

Generally, referring primarily to FIGS. 2 and 3 and secondarily to FIGS. 5, 8, 10 and 21, the monitored fluid 14 within structure 12 flows as through apertures or passages 52, 56 and 58 into chamber 44, of lower assembled housing section 30 and, of course, assumes a level (height) which is the same as that within the fluid monitored within structure 12 and surrounding the lower housing section 32. As the level (height) of the monitored fluid 14 rises and falls, the float and actuating assembly 186 correspondingly rises and falls within housing 32 chamber 44 thereby likewise moving toward and away from the upper housing section 30 and the reed switch assembly 172 carried by and encapsulated within the body material of upper housing section 30.

When the level (elevation) of the monitored liquid 14 increases to a preselected elevation, the float and actuating assembly 186 is correspondingly raised (moved toward upper housing section 30) to a position whereby the magnetic field of magnet means 190 is sufficient to cause leaf contacts 180 and 182 to move against each other and thereby close the electrical circuit therethrough and through associated conductor means 22 and 24 respectively electrically connected to terminal means 16 and 18 blade contacts 116 and 104 thereby providing an appropriate electrical output to associated electrical load means 20. Of course, when the level (elevation) of the monitored liquid 14 again decreases to below a preselected elevation or magnitude, the magnet means 190 correspondingly moves away from the encapsulated reed switch assembly 172 thereby sufficiently bringing the reed switch leaf contacts 180 and 182 out of the realm of influence of the magnet field of magnet means 190 permitting the leaf contacts 180 and 182 to move away from each other and electrically open the circuit therethrough.

Referring to FIGS. 4, 5, 6 and 7, it can be seen that in the preferred embodiment passage means (as 52, 56 and 58) for enabling the flow of monitored fluid into chamber 44 are provided at the bottom end of lower housing section 32 in preference to functionally similar passage means formed through the tubular wall 34 of the housing section 32. This prevents any undesirable effect which the monitored fluid may have on the float and actuating means 186 as might otherwise occur by generally transversely directed fluid currents occasioned as by the monitored fluid flowing through access apertures or passages formed through the cylindrical wall 34 of lower housing section 32. Also, in the preferred embodiment, abutment or raised portion means 46 is situated and carried by the end wall 38 as to extend or project generally inwardly of chamber means 44. Such abutment means 46 is provided for that event wherein because of sufficient reduction in the level (elevation) of the monitored fluid, the float and actuating assembly 186 may actually move downwardly a distance sufficient whereby the lower end 200 of float assembly 186 would otherwise become seated against the inner surface 42 of the end wall 38. If this were to occur, the float assembly 186, by virtue of possible surface adhesion, could at least be delayed in its response to a subsequently rising level height) of the monitored fluid 14. By having an abutment means 46, which as best shown in FIG. 7, is much of a knife-edge like configuration, the float assembly 186 abuts thereagainst (when the level of the monitored fluid is sufficiently reduced) instead of against the inner surface 42 of end wall 38. Consequently, there is only an insignificant amount of surface-to-surface contact as between end 200 of float assembly 186 and abutment means 46, when engagement occurs therebetween, and the problem of surface adhesion is eliminated.

Further, in the preferred embodiment, the abutment means 46 is formed as to be discontinuous thereby assuring that when the monitored fluid 14 flows into chamber 44 through passages 52, 56 and 58, even with float assembly 186 seated against abutment or stop means 46, that the fluid flows both against the end surface 200 (of float assembly 186) which is generally radially inwardly of the abutment 46 and flows against the end surface 200 (of float assembly 186) and float body 188 which is positioned generally radially outwardly of abutment means 46 thereby, in effect, applying an immediate buoyant force against the entire exposed surface of float body 188.

Still further, in the preferred embodiment, the float body 188 is formed as to be of a right polyhedron having opposed ends and a plurality of outer longitudinally extending planar surfaces 198. In the event that the float body 188 should come into side-to-side contact with the inner cylindrical surface 40 of the lower housing section 32, the relative sharper corners, as exist at the juncture of adjacent planar surfaces 198, will be less susceptible to the occurrence of hysteresis arising out of any meniscus as might be experienced between surface 40 and the sharper corners which would be lesser in extent than if the outer longitudinally extending surface of the float body 186 were of a cylindrical configuration closely approaching, in diametrical size that of surface 40.

Figure 11:
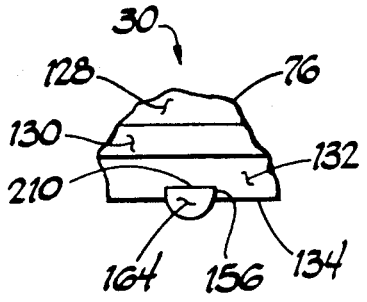
FIG. 11 is a view, in relatively enlarged scale, of a fragmentary portion of the structure of FIGS. 8 and 9, taken generally on the plane of line 11—11 of FIG. 8 and looking in the direction of the arrows.

Also, although the practice of the invention is not so limited, in the preferred embodiment the width of the projecting latching portions 154, 150, 156 and 152 closely approaches the width of the respective cooperating latching slots 60, 66, 64 and 62; this combined with the fact that the latching projections are preferably formed as to have upper disposed flat transverse surfaces, as typically depicted at 210 of FIG. 11, and that the upper end of each of the latching slots is formed as to be an arc or have a semi-circular configuration, as typically illustrated at 68 of FIG. 5, results in a continuing resilient force urging the lower housing section 32 and upper housing section 30 axially toward each other. More particularly, as typically illustrated in FIG. 3, when the upper and lower housing sections, 30 and 32, are latched together, in the preferred embodiment, the relatively sharp corners of the latching projections, determined as by the intersection of the flat surface 210 with the outer side disposed surface of the latching projection, effectively engage the curvilinear end 68 and because there is, at such areas of engagement, relatively small surface areas undergoing compressive forces, a degree of resilient compression is experienced therebetween and such resilient compression further tends to urge the upper and lower housing sections, 30 and 32, axially toward each other.

Another benefit obtained by the practice of the invention is that since the reed switch assembly 172 is simultaneously encapsulated within the material forming the upper housing section 30, during the molding thereof, the electrical switch mechanism 172 is completely protected by the surrounding plastic material as to preclude damage thereto during, production, shipping and use. Further, unlike many prior art switch assemblies wherein electrical switch contacts are exposed to ambient atmosphere or sealed within a chamber containing ambient atmosphere, and thereby are subjected to corrosion and oxidation, the reed switch assembly 172, as employed in the invention, has its housing 174 evacuated and thereby preventing corrosion and oxidation of its switch or leaf contacts 180 and 182.

Also, contrary to the prior art wherein, at least usually, spring means either built into the electrical switch contacts or separate therefrom are employed for resiliently urging and/or resisting opening or closing movement of such contacts, the leaf type contacts 180 and 182 of the reed switch 172 of the invention is free from the action of associated spring means thereby obviating, especially during production, the necessity of calibrating spring action and switch contact operations as required in the prior art.

Still further, since the entire assembly 170 (FIG. 21) is placed as an insert into the mold which is used for molding the upper housing section 30, the location of the assembly 170, and in particular the location of the reed switch assembly 172, within the overall molded upper housing section 30 will be dimensionally uniformly consistent. This, in turn, translates into the beneficial condition that closure and opening of the leaf contacts 180 and 182 can be assured whenever the magnet means 190 is brought to a preselected distance of rib 146 since such, in turn, is also a second preselected distance from the reed switch assembly 172.

In view of the foregoing it should now be apparent that the invention also provides a novel and simple method of constructing the liquid level switch assembly 10 resulting in a completed assembly in which no further steps of calibration are required.

For example, such method of manufacture would, variously, comprise the steps of: (a) forming the electrical conductor or terminal means 16 and 18; (b) electrically connecting the reed switch assembly 172 in circuit with the conductor or terminal means 16 and 18; (c) placing the connected reed switch assembly 172 and conductor means 16 and 18, as an assembly 170, as an insert, into a mold cavity; (d) filling the mold cavity with a dielectric material as to thereby form a dielectric body 30 which encapsulates the reed switch assembly 172 and at least in part surrounds the conductor means 16 and 18; (e) forming a containment member 32, as by molding, to provide chamber-like means 44; (f) forming a magnet member 190; (g) forming a buoyant float member 188; (h) placing the magnet member 190 and buoyant float member 188 into the chamber-like means 44 of the housing or containment means 32; and (i) securing the dielectric body 30 to the housing or containment member 32 to thereby complete the assembly of the switch assembly 10.

Figure 23:
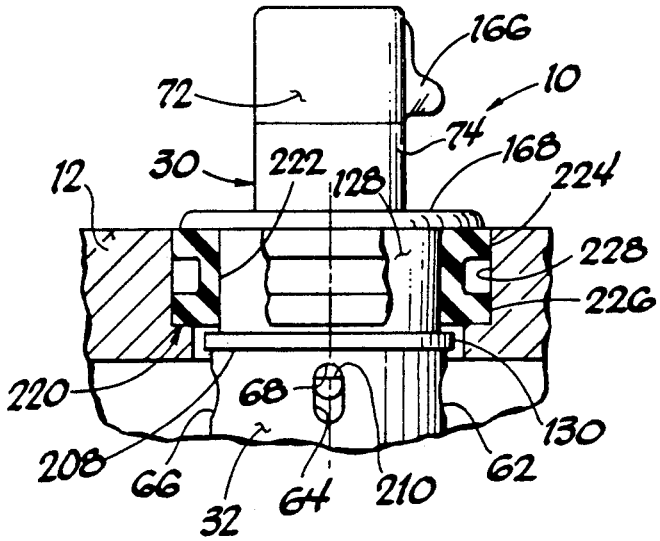
FIG. 23 is a view similar to a fragmentary portion of FIG. 3 and illustrating a further embodiment of the invention.

FIG. 23 illustrates a somewhat modified form of operatively securing the switch assembly 10 to the associated structure 12. As shown, an annular elastomeric member 220 is placed onto and about the cylindrical surface 128 of housing section 30 as to have the inner cylindrical surface 222 of member 220 in engagement with outer cylindrical surface 128 of housing section 30. Preferably, the member 220 is comprised of two radially extending flange-like portions 224 and 226 which are axially spaced from each other. With such relatively resilient member 220 situated onto housing section, all that is necessary to sealingly secure the switch assembly 10 to the associated structure 12 is to press the switch assembly 10 and member 220 into the bore or aperture 228 of structure 12 thereby causing both radial compression of the member 220 and some resilient deflection of the flanges 224 and 226 with the result that the switch assembly 10 is held in place and operatively assembled to the structure 12.

Figure 24:
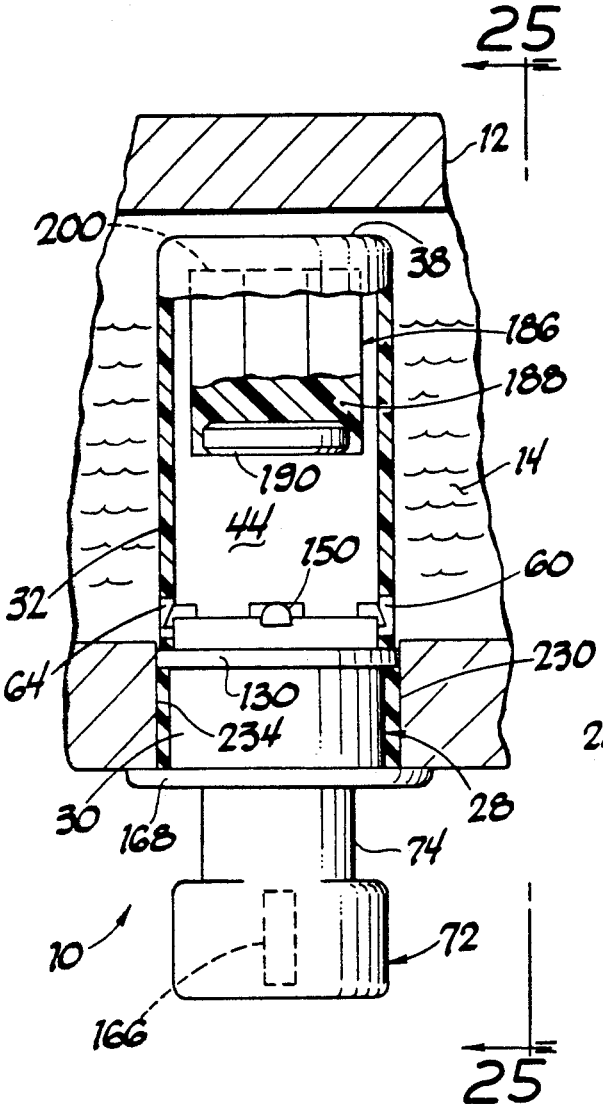
FIG. 24 is a view similar to that of FIG. 2 but illustrating the invention in a bottom mounted mode of operation.
Figure 25:
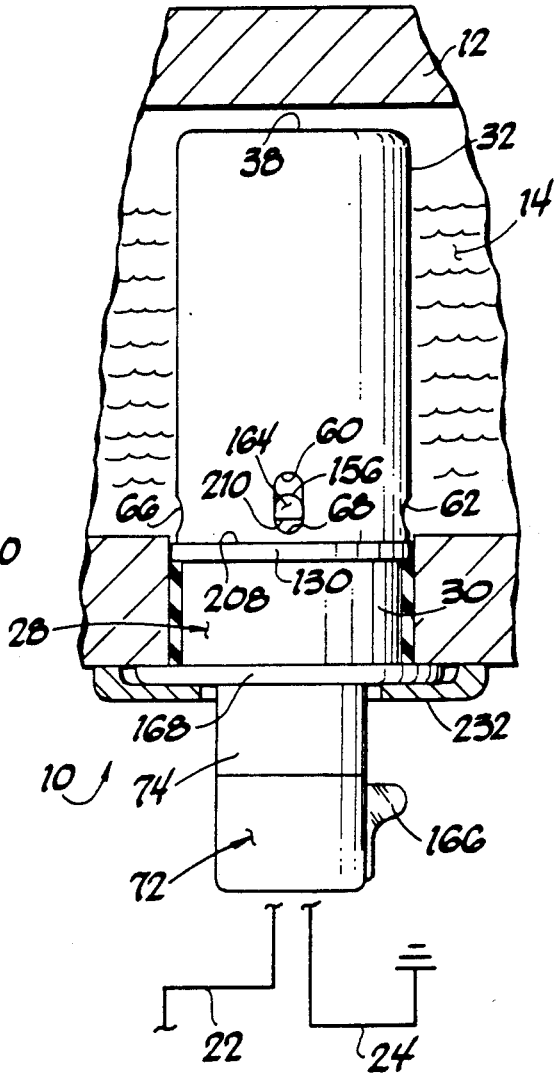
FIG. 25, similar to FIG. 3, is a view taken generally on the plane of line 25—25 of FIG. 24 and looking in the direction of the arrows.

Another important feature and aspect of the invention is illustrated in FIGS. 24 and 25. In FIGS. 24 and 25 the switch assembly 10 corresponds to that of FIGS. 1, 2 and 3 and all elements in FIGS. 24 and 25 corresponding to the elements in previous Figures are identified with like reference numbers.

Referring in greater detail to FIGS. 24 and 25, it can be seen that the switch assembly 10 is mounted as through a lower situated aperture or passage 234 in structure 12 and positioned as to be reverse to that depicted in FIGS. 2 and 3. In effect, this comprises a combination of a structure, having liquid the level or elevation of which is to be monitored, and a liquid level responsive switch assembly 10 mounted in what amounts to a bottom or lower level of such structure. Consequently, end wall 38 of housing or body means 32 now becomes upper disposed and the magnet means 190, carried by the float assembly 186, also becomes lower disposed in relation to float body 188 within chamber 44. As can be seen, in the preferred embodiment, the now lower situated apertures 60, 62, 64 and 66 also provide for the flow of the monitored liquid 14 into chamber 44 while the other apertures such as 56, 52 and 58 in housing body 32 assure venting as to preclude the occurrence of air or vapor being trapped within chamber 44.

If desired, suitable sealing means may be provided as between the switch assembly 10 and structure 12 and such sealing means may be situated, for example, generally about upper housing or body means 30 as depicted at 230. Also, as generally depicted, suitable clamping means 232 may be provided as to positively secure switch assembly 10, as through operative engagement with flange 168, to the associated structure 12.

Although only a preferred embodiment and one modification of the invention has been disclosed and described it is apparent that other embodiments and modifications are possible within the scope of the appended claims.

What is claimed is:

1. A liquid level responsive electrical switch assembly responsive to the level of a monitored liquid, comprising housing means, said housing means comprising body means and chamber-like means, electrical conductor means carried by said body means for operative connection to associated electrical load means, electrical reed switch means connected to said electrical conductor means and having first and second states of operation, wherein when in said first state of operation said reed switch means is effective for opening an electrical circuit through said electrical conductor means, wherein when in said second state of operation said reed switch means is effective for closing an electrical circuit through said electrical conductor means, wherein said electrical reed switch means is encapsulated by and within said body means, magnet means situated within said chamber-like means, said magnet means when moved toward said body means and said electrical reed switch means so as to be spaced from said electrical reed switch means by a preselected distance being effective to cause said reed switch means to change from one of said states of operation to the other of said states of operation, buoyant float means operatively connected to said magnet means and acted upon and responsive to the level of said monitored liquid for causing said magnet means to be moved towards and away from said body means and said electrical reed switch means in response to the rise and fall of the level of said monitored liquid, a housing section, wherein said chamber-like means is formed generally within said housing section, wherein said housing section is comprised of non-magnetizable material, wherein said housing section is of a generally tubular configuration and connected at one tubular end portion to said body means, abutment means carried by said housing section as to thereby contain said magnet means and said buoyant float means within said chamber-like means and between said body means and said abutment means, wherein said housing section comprises wall means situated generally transversely thereof, and wherein said wall means carries said abutment means, and further comprising passage means formed through said wall means and extending through said abutment means for the flow therethrough and into said chamber-like means of said monitored liquid.

2. A liquid level responsive electrical switch assembly responsive to the level of a monitored liquid, comprising housing means, said housing means comprising body means and chamber-like means, electrical conductor means carried by said body means for operative connection to associated electrical load means, electrical reed switch means connected to said electrical conductor means and having first and second states of operation, wherein when in said first state of operation said reed switch means is effective for opening an electrical circuit through said electrical conductor means, wherein when in said second state of operation said reed switch means is effective for closing an electrical circuit through said electrical conductor means, wherein said electrical reed switch means is encapsulated by and within said body means, magnet means situated within said chamber-like means, said magnet means when moved toward said body means and said electrical reed switch means so as to be spaced from said electrical reed switch means by a preselected distance being effective to cause said reed switch means to change from one of said states of operation to the other of said states of operation, buoyant float means operatively connected to said magnet means and acted upon and responsive to the level of said monitored liquid for causing said magnet means to be moved toward and away from said body means and said electrical reed switch means in response to the rise and fall of the level of said monitored liquid, a housing section, wherein said chamber-like means is formed generally within said housing section, wherein said housing section is comprised of non-magnetizable material, wherein said housing section is of a generally tubular configuration and connected at one tubular end portion to said body means, abutment means carried by said housing section as to thereby contain said magnet means and said buoyant float means within said chamber-like means and between said body means and said abutment means, wherein said housing section comprises wall means situated generally transversely thereof, and wherein said wall means carries said abutment means, wherein said abutment means is integrally formed with said wall means, and further comprising passage means formed through said wall means and said abutment means for the flow therethrough and into said chamber-like means of said monitored liquid.

3. A liquid level responsive electrical switch assembly responsive to the level of a monitored liquid, comprising housing means, said housing means comprising body means and chamber-like means, electrical conductor means carried by said body means for operative connection to associated electrical load means, electrical reed switch means connected to said electrical conductor means and having first and second states of operation, wherein when in said first state of operation said reed switch means is effective for opening an electrical circuit through said electrical conductor means, wherein when in said second state of operation said reed switch means is effective for closing an electrical circuit through said electrical conductor means, wherein said electrical reed switch means is encapsulated by and within said body means, magnet means situated within said chamber-like means, said magnet means when moved upward toward said body means and said electrical reed switch means so as to be spaced from said electrical reed stitch means by a preselected distance being effective to cause said reed switch means to change from one of said states of operation to the other of said states of operation, buoyant float means operatively connected to said magnet means and acted upon and responsive to the level of said monitored liquid for causing said magnet means to be moved toward and away from said body means and said electrical reed switch means in response to the rise and fall of the level of said monitored liquid, a housing section, wherein said chamber-like means is formed generally within said housing section, wherein said housing section is comprised of non-magnetizable material, wherein said housing section is of a generally tubular configuration and connected at one tubular end portion to said body means, abutment means carried by said housing section as to thereby contain said magnet means and said buoyant float means within said chamber-like means and between said body means and said abutment means, wherein said housing section comprises wall means situated generally transversely thereof, wherein said wall means carries said abutment means, wherein said abutment means is integrally formed with said wall means, wherein said abutment means is of a generally arcuate configuration, and wherein said abutment means comprises a projecting surface of minimal contact area for engagement by said buoyant float means, and further comprising passage means formed through said wall means and said generally arcuate abutment means for the flow therethrough and into said chamber-like means of said monitored liquid.

4. A liquid level responsive electrical switch assembly according to claim 3 wherein said passage means comprises at least first and second passages, wherein said first passage is formed through said wall means and said arcuate abutment means, and wherein said second passage is formed through said wall means generally centrally of said arcuate abutment means.

5. A liquid level responsive electrical switch assembly responsive to the level of a monitored liquid, comprising housing means, said housing means comprising body means and chamber-like means, electrical conductor means carried by said body means for operative connection to associated electrical load means, electrical reed switch means connected to said electrical conductor means and having first and second states of operation, wherein when in said first state of operation said reed switch means is effective for opening an electrical circuit through said electrical conductor means, wherein when in said second state of operation said reed switch means is effective for closing an electrical circuit through said electrical conductor means, wherein said electrical reed switch means is encapsulated by and within said body means, magnet means situated within said chamber-like means, said magnet means when moved toward said body means and said electrical reed switch means so as to be spaced from said electrical reed switch means by a preselected distance being effective to cause said reed switch means to change from one of said states of operation to the other of said states of operation, buoyant float means operatively connected to said magnet means and acted upon and responsive to the level of said monitored liquid for causing said magnet means to be moved toward and away from said body means and said electrical reed switch means in response to the rise and fall of the level of said monitored liquid, and further comprising a housing section, wherein said chamber-like means is formed generally within said housing section, wherein said housing section is of a generally tubular configuration, first and second securing means respectively carried by said body means and said housing section, and wherein when said body means and said housing section are moved toward each other as to cause said first and second securing means to become operatively connected to each other said housing section becomes secured to said body means.

6. A liquid level responsive electrical switch assembly according to claim 5 wherein one of said first and second securing means comprises at least one rib-like projection, wherein the other of said first and second securing means comprises aperture-like means, and wherein when said housing section becomes secured to said body means said rib-like projection is operatively received by said aperture-like means.

7. A liquid level responsive electrical switch assembly according to claim 6 wherein said housing section is of a generally cup-shaped configuration having a longitudinally extending cylindrical wall having an open end at a first axial end thereof and a transverse wall at a second axial end thereof, wherein said open end is circumscribably receivable about a portion of said body means, wherein said body means comprises a plurality of projecting latching portions, wherein said housing section comprises a plurality of latching apertures, wherein said plurality of projecting latching portions are respectively latchingly engageable with said plurality of latching apertures, and wherein when said latching portions and said latching apertures are latchingly engaged with each other said open end is received about said portion of said body means.

8. A liquid level responsive electrical switch assembly responsive to the level of a monitored liquid, comprising housing means, said housing means comprising body means and chamber-like means, electrical conductor means carried by said body means for operative connection to associated electrical load means, electrical reed switch means connected to said electrical conductor means and having first and second states of operation, wherein when in said first state of operation said reed switch means is effective for opening an electrical circuit through said electrical conductor means, wherein when in said second state of operation said reed switch means is effective for closing an electrical circuit through said electrical conductor means, wherein said electrical reed switch means is encapsulated by and within said body means, magnet means situated within said chamber-like means, said magnet means when moved toward said body means and said electrical reed switch means so as to be spaced from said electrical reed switch means by a preselected distance being effective to cause said reed switch means to change from one of said states of operation to the other of said states of operation, and buoyant float means operatively connected to said magnet means and acted upon and responsive to the level of said monitored liquid for causing said magnet means to be moved toward and away from said body means and said electrical reed switch means in response to the rise and fall of the level of said monitored liquid, wherein said body means is molded and comprised of dielectric material, wherein said body means comprises a generally cylindrical body portion having first and second ends, wherein said electrical conductor means comprises at least first and second electrical contacts carried by said body portion and extending from said first end, wherein said reed switch means is encapsulated within said body portion as to be located at least near said second end, and wherein said reed switch means is positioned as to be generally normal to the direction of the axis of said cylindrical body portion.

9. A liquid level responsive electrical switch assembly according to claim 8 wherein said electrical conductor means further comprises at least first and second leg-like portions respectively operatively connected to said first and second electrical contacts, wherein each of said first and second leg-like portions are encapsulated within said cylindrical body portion, and wherein said reed switch means is electrically connected to and between said first and second leg-like portions.

10. A liquid level responsive electrical switch assembly according to claim 9 wherein said first leg-like portion is eccentrically disposed with respect to said first electrical contact, wherein said second leg-like portion is eccentrically disposed with respect to said second electrical contact, and wherein said electrical conductor means further comprises first and second conductor body sections wherein each of said first and second conductor body sections encapsulated within said cylindrical body portion wherein said first conductor body section Joins said first leg-like portion to said first electrical contact, and wherein said second conductor body section joins said second leg-like portion to said second electrical contact.

11. A liquid level responsive electrical switch assembly according to claim 8 wherein said second end of said body portion comprises an integrally formed rib-like portion extending transversely of said cylindrical body portion and wherein said reed switch means is at least partly situated within said rib-like portion.

12. A liquid level responsive electrical switch assembly responsive to the level of a monitored liquid, comprising housing means, said housing means comprising body means and chamber-like means, electrical conductor means carried by said body means for operative connection to associated electrical load means, electrical reed switch means connected to said electrical conductor means and having first and second states of operation, wherein when in said first state of operation said reed switch means is effective for opening an electrical circuit through said electrical conductor means, wherein when in said second state of operation said reed switch means is effective for closing an electrical circuit through said electrical conductor means, wherein said electrical reed switch means is encapsulated by and within said body means, magnet means situated within said chamber-like means, said magnet means when moved toward said body means and said electrical reed switch means so as to be spaced from said electrical reed switch means by a preselected distance being effective to cause said reed switch means to change from one of said states of operation to the other of said states of operation, buoyant float means operatively connected to said magnet means and acted upon and responsive to the level of said monitored liquid for causing said magnet means to be moved toward and away from said body means and said electrical reed switch means in response to the rise and fall of the level o f said monitored liquid, wherein said body means is molded and comprised of dielectric material, wherein said body means comprises a generally cylindrical body portion having first and second ends, wherein said electrical conductor means comprises at least first and second electrical contacts carried by said body portion and extending from said first end, wherein said reed switch means is encapsulated within said body portion as to be located at least near said second end, and wherein said reed switch means is positioned as to be generally normal to the direction of the axis of said cylindrical body portion, and further comprising a first plurality of latching portions carried by said cylindrical body portion and extending generally radially outwardly therefrom, wherein each of said first plurality of latching portions comprises camming surface means, a generally tubular housing section, wherein said chamber-like means is at least in part defined by said generally tubular housing section, a second plurality of latching portions carried by said tubular housing section, wherein when said cylindrical body portion and said generally tubular housing section are being assembled said camming surface means are effective to engage said generally tubular housing section and yieldingly urge portions of said generally tubular housing section radially outwardly to thereby permit said first plurality of latching portions to pass within said generally tubular housing section toward operative engagement with said second plurality of latching portions.

13. A liquid level responsive electrical switch assembly according to claim 12 wherein said second end of said body portion comprises an integrally formed rib-like portion extending transversely of said cylindrical body portion, wherein said reed switch means is at least partly received within said rib-like portion, and wherein at least one of said first plurality of latching portions comprises a general radially directed extension of said integrally formed rib-like portion.

14. A liquid level responsive electrical switch assembly according to claim 13 and further comprising an annular elastomeric member carried by and circumferentially against said cylindrical body portion as to be extending axially therealong and radially outwardly therefrom.

15. In combination, structure for containing liquid the level of which is to be monitored, a passage formed in said structure at a lower disposed portion of said structure, and a liquid level responsive electrical switch assembly extending through said passage and into said monitored liquid as to be responsive to the level of said monitored liquid, wherein said electrical switch assembly comprises body means, wherein said body means comprises first and second housing means, wherein said first housing means comprises a first relatively upper end and a second relatively lower end, wherein said second housing means comprises a third relatively upper end and a fourth relatively lower end, wherein said fourth relatively lower end of said second housing means is operatively secured to said first relatively upper end of said first housing means, wherein a float assembly buoyant in and responsive to the level of said monitored liquid is situated above said first housing means and contained by said second housing means, wherein said float assembly comprises a float body and magnet means, wherein said float assembly is positioned as to have said magnet means disposed closer to said first relatively upper end of said first housing means than is the major portion of said float body, wherein said monitored liquid flows through said second housing means as to be in intimate contact with said first relatively upper end of said first housing means and as to act upon said float assembly to cause said float assembly to rise and fall in response to the rise and fall of said monitored liquid, electrical conductor means carried by said first housing means for operative connection to associated electrical load means, electrical reed switch means connected to said electrical conductor means and having first and second states of operation, wherein when in said first state of operation said reed switch means is effective for opening an electrical circuit through said electrical conductor means, wherein when in said second state of operation said reed switch means is effective for closing an electrical circuit through said electrical conductor means, wherein said electrical reed switch means is encapsulated by and within said first housing means as to be situated transversely of said first housing means and closely disposed to said first relatively upper end of said first housing means, wherein when said float body and magnet means move toward said first relatively upper end of said first housing means and said encapsulated electrical reed switch means so as to have said magnet means be spaced from said electrical reed switch means by a preselected distance said magnet means becomes effective to cause said reed switch means to change from one of said first and second states of operation to the other of said first and second states of operation.

16. In combination, structure for containing liquid the level of which is to be monitored, a passage formed in said structure at a lower disposed portion of said structure, and a liquid level responsive electrical switch assembly extending through said passage and into said monitored liquid as to be responsive to the level of said monitored liquid, wherein said electrical switch assembly comprises body means, wherein said body means comprises first and second housing means, wherein said first housing means comprises a first relatively upper end and a second relatively lower end, wherein said second housing means comprises a third relatively upper end and a fourth relatively lower end, wherein said fourth relatively lower end of said second housing means is operatively secured to said first relatively upper end of said first housing means, wherein a float assembly buoyant in and responsive to the level of said monitored liquid is situated above said first housing means and contained by said second housing means, wherein said float assembly comprises a float body and magnet means, wherein said float assembly is positioned as to have said magnet means disposed closer to said first relatively upper end of said first housing means than is the major portion of said float body, wherein said monitored liquid flow through said second housing means as to be in intimate contact with said first relatively upper end of said first housing means and as to act upon said float assembly to cause said float assembly to rise and fall in response to the rise and fall of said monitored liquid, electrical conductor means carried by said first housing means for operative connection to associated electrical load means, electrical reed switch means connected to said electrical conductor means and having first and second states of operation, wherein when in said first state of operation said reed switch means is effective for opening an electrical circuit through said electrical conductor means, wherein when in said second state of operation said reed switch means is effective for closing an electrical circuit through said electrical conductor means, wherein said electrical reed switch means is encapsulated by and within said first housing means as to be situated transversely of said first housing means and closely disposed to said first relatively upper end of said first housing means, wherein said float body and magnet means move toward said first relatively upper end of said first housing means and said encapsulated electrical reed switch means so as to have said magnet means be spaced from said electrical reed switch means by a preselected distance said magnet means becomes effective to cause said reed switch means to change from one of said first and second stats of operation to the other of said first and second states of operation, wherein said first housing means comprises a generally transversely extending flange portion, and further comprising clamping means operatively engaging said flange portion as to prevent downward withdrawal of said first housing means from said passage.

17. The combination according to claim 16 and further comprising sealing means operatively sealingly engaging said first housing means and said lower disposed portion of said structure to seal against leakage flow of said monitored liquid between said first housing means and said lower disposed portion of said structure.

18. In combination, structure for containing liquid the level of which is to be monitored, a passage formed in said structure, and a liquid level responsive electrical switch assembly extending through said passage and into said monitored liquid as to be responsive to the level of said monitored liquid, comprising housing means, said housing means comprising body means and chamber-like means, electrical conductor means carried by said body means for operative connection to associated electrical load means, electrical reed stitch means connected to said electrical conductor means and having first and second states of operation, wherein when in said first state of operation said reed switch means is effective for opening an electrical circuit through said electrical conductor means, wherein when in said second state of operation said reed switch means is effective for closing an electrical circuit through said electrical conductor means, wherein said electrical reed switch means is encapsulated by and within said body means, magnet means situated within said chamber-like means, said magnet means when moved toward said body means and said electrical reed switch means as to be spaced from said electrical reed switch means by a preselected distance being effective to cause said reed switch means to change from one of said states of operation to the other of said states of operation, and buoyant float means operatively connected to said magnet means and acted upon and responsive to the level of said monitored liquid for causing said magnet means to be moved toward and away from said body means and said electrical reed switch means in response to the rise and fall of the level of said monitored liquid, wherein said body means comprises a generally transversely extending flange portion, and further comprising clamping means operatively engaging said flange portion as to prevent withdrawal of said body means from said passage.

* * * * *

UNITED STATES PATENT AND TRADEMARK OFFICE

CERTIFICATE OF CORRECTION

PATENT NO. : 5,026,954

DATED : June 25, 1991

INVENTOR(S) : David J. Cebulski

It is certified that error appears in the above-identified patent and that said Letters Patent is hereby corrected as shown below:

In the ABSTRACT, line 5 thereof, change "as" to --- an ---.

Column 1, line 33, between "moved" and "by" insert --- upwardly ---.

Column 3, line 42 immediately after "14" add --- -20; ---.

Column 6, line 2, before "not" insert --- ( ---.

Column 13, line 23 (Claim 3, line 18 thereof), delete "upward".

Column 13, line 25 (Claim 3, line 20 thereof), change "stitch" to --- switch ---.

UNITED STATES PATENT AND TRADEMARK OFFICE

CERTIFICATE OF CORRECTION

PATENT NO. : 5,026,954

DATED : June 25, 1991

INVENTOR(S) : David J. Cebulski

It is certified that error appears in the above-identified patent and that said Letters Patent is hereby corrected as shown below:

Column 14, line 43 (Claim 7, line 2 thereof), change "6" to --- 5 ---.

Column 15, line 46 (Claim 10, line 8 thereof), immediately after "sections" insert a comma (,).

Column 15, line 47 (Claim 10, line 9 thereof), after "sections" insert --- is ---.

Column 15, line 48 (Claim 10, line 10 thereof), immediately after "portion" insert a comma (,).

Column 15, line 49 (Claim 10, line 11 thereof), change "Joins" to --- joins ---.

Column 15, line 57 (Claim 11, line 5 thereof), immediately after "portion" insert a comma (,).

Column 18, line 4 (Claim 16, line 25 thereof), change "flow" to --- flows ---.

UNITED STATES PATENT AND TRADEMARK OFFICE

CERTIFICATE OF CORRECTION

PATENT NO. : 5,026,954

DATED : June 25, 1991

INVENTOR(S) : David J. Cebulski

It is certified that error appears in the above-identified patent and that said Letters Patent is hereby corrected as shown below:

Column 18, line 24 (Claim 16, line 45 thereof), before "said float" insert --- when ---.

Column 18, line 30 (Claim 16, line 51 thereof), change "stats" to --- states ---.

Column 18, line 53 (Claim 18, line 10 thereof), change "stitch" to --- switch ---.

This certificate supersedes Certificate of Correction issued October 6, 1992.

Signed and Sealed this

Fifth Day of January, 1993

*Attest:*

*Attesting Officer*

DOUGLAS B. COMER

*Acting Commissioner of Patents and Trademarks*